US011086247B2

(12) United States Patent
Tonges

(10) Patent No.: US 11,086,247 B2
(45) Date of Patent: Aug. 10, 2021

(54) ELECTRICAL CONNECTION FOR AN IMAGING COMPONENT OF AN ELECTROPHOTOGRAPHIC IMAGE FORMING DEVICE

(71) Applicant: LEXMARK INTERNATIONAL, INC., Lexington, KY (US)

(72) Inventor: Jeffrey Lawrence Tonges, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/082,702

(22) Filed: Oct. 28, 2020

(65) Prior Publication Data

US 2021/0200113 A1 Jul. 1, 2021

Related U.S. Application Data

(60) Provisional application No. 62/954,095, filed on Dec. 27, 2019, provisional application No. 63/026,210, filed on May 18, 2020.

(51) Int. Cl.
*G03G 15/02* (2006.01)
*G03G 21/00* (2006.01)

(52) U.S. Cl.
CPC ..... *G03G 15/0233* (2013.01); *G03G 21/0023* (2013.01)

(58) Field of Classification Search
CPC ..... G03G 15/0283; G03G 21/0023; G03G 21/1652
USPC ..... 399/90
See application file for complete search history.

(56) References Cited

U.S. PATENT DOCUMENTS 5,768,660 A * 6/1998 Kurihara et al. .. G03G 15/0216 399/176
6,064,841 A * 5/2000 Matsuzaki et al. ..... G03G 15/0216 399/90
6,144,819 A * 11/2000 Nishiuwatoko .... G03G 15/0216 399/90
6,249,659 B1 6/2001 Stickler
7,050,736 B2 5/2006 Hale et al.
7,231,163 B2 6/2007 Gopalanarayanan et al.
7,356,278 B2 4/2008 Piotrowski et al.
8,588,640 B2 * 11/2013 Kubo et al. ..... G03G 15/0283 399/90
8,918,008 B2 * 12/2014 Okamoto et al. .. G03G 21/1652 399/90

(Continued)

*Primary Examiner* — William J Royer
(74) *Attorney, Agent, or Firm* — Justin M. Tromp

(57) ABSTRACT

An assembly for an electrophotographic image forming device according to one example includes a rotatable roll having an electrically conductive shaft. An electrically conductive bracket is positioned adjacent to the roll and in a spaced relationship from the roll along a length of the roll. An electrical contact is positioned to receive an electrical voltage from a power supply of the image forming device. The electrical contact is electrically connected to a first end portion of the shaft of the roll by way of a first electrical path and to a second end portion of the shaft of the roll by way of a second electrical path to transfer the electrical voltage to the roll. The bracket forms a portion of the second electrical path such that the electrical voltage transferring from the electrical contact to the second end portion of the shaft of the roll passes through the bracket.

18 Claims, 10 Drawing Sheets

(56) References Cited

U.S. PATENT DOCUMENTS

| | | | |
|---|---|---|---|
| 9,207,555 | B1 | 12/2015 | Hoy et al. |
| 9,519,262 | B1 | 12/2016 | Tonges et al. |
| 10,338,518 | B2 | 7/2019 | Cavill et al. |
| 10,691,062 | B1 | 6/2020 | Amann et al. |

* cited by examiner

ELECTRICAL CONNECTION FOR AN IMAGING COMPONENT OF AN ELECTROPHOTOGRAPHIC IMAGE FORMING DEVICE

CROSS REFERENCES TO RELATED APPLICATIONS

This application claims priority to U.S. Provisional patent Application Ser. No. 62/954,095, filed Dec. 27, 2019, entitled "Charge Roll and Cleaner Blade Electrical Path," and to U.S. Provisional patent Application Ser. No. 63/026,210, filed May 18, 2020, entitled "Electrical Connection for an Imaging Component of an Electrophotographic Image Forming Device," the contents of which are hereby incorporated by reference in their entirety.

BACKGROUND

1. Field of the Disclosure

The present disclosure relates generally to image forming devices and more particularly to an electrical connection for an imaging component of an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper), either directly by the photoconductive drum or indirectly by an intermediate transfer member. The toner is then fused to the media using heat and pressure to complete the print.

The image forming device typically includes one or more replaceable units that have a shorter lifespan than the image forming device. Each replaceable unit may include one or more imaging components, such as a photoconductive drum, a charge roll, a cleaner blade or roll, a developer roll, a doctor blade, a toner adder roll, etc., that require electrical voltage from a power supply in the image forming device in order to electrostatically move toner from one component to another. Accordingly, the replaceable unit(s) may include one or more electrical contacts that mate with corresponding electrical contacts in the image forming device upon installation of the replaceable unit in the image forming device in order to provide an electrical connection between the power supply of the image forming device and the replaceable unit. It is desired for imaging components requiring an electrical voltage to maintain a consistent electrical connection in order to permit continued operation and to avoid print defects. It is desired for the electrical connections to be robust and effective while also minimizing cost.

SUMMARY

An assembly for an electrophotographic image forming device according to one example embodiment includes a rotatable roll having an electrically conductive shaft. An electrically conductive bracket is positioned adjacent to the roll and in a spaced relationship from the roll along a length of the roll. An electrical contact is positioned to receive an electrical voltage from a power supply of the image forming device. The electrical contact is electrically, connected to a first end portion of the shaft of the roll by way of a first electrical path and is electrically connected to a second end portion of the shaft of the roll by way of a second electrical path to transfer the electrical voltage to the roll. The second end portion of the shaft of the roll is positioned opposite the first end portion of the shaft of the roll. The bracket forms a portion of the second electrical path such that the electrical voltage transferring from the electrical contact to the second end portion of the shaft of the roll passes through the bracket.

An assembly for an electrophotographic image forming device according to another example embodiment includes a rotatable photoconductive drum. A rotatable charge roll has an electrically conductive shaft. An outer surface of the charge roll contacts an outer surface of the photoconductive drum along a length of the photoconductive drum. A cleaner blade is in contact with the outer surface of the photoconductive drum along the length of the photoconductive drum for removing residual toner from the outer surface of the photoconductive drum. The cleaner blade is mounted to an electrically conductive bracket and extends from the bracket toward the photoconductive drum. An electrical contact is positioned to receive an electrical voltage from a power supply of the image forming device. The electrical contact is electrically connected to a first end portion of the shaft of the charge roll by way of a first electrical path and is electrically connected to a second end portion of the shaft of the charge roll by way of a second electrical path to transfer the electrical voltage to the charge roll for charging the outer surface of the photoconductive drum. The second end portion of the shaft of the charge roll is positioned opposite the first end portion of the shaft of the charge roll. The bracket forms a portion of the second electrical path such that the electrical voltage transferring from the electrical contact to the second end portion of the shaft of the charge roll passes through the bracket.

A replaceable unit for use in an electrophotographic image forming device according to one example embodiment includes a rotatable photoconductive drum. A rotatable charge roll has an electrically conductive shaft. An outer surface of the charge roll contacts an outer surface of the photoconductive drum along a length of the photoconductive drum. A cleaner blade is in contact with the outer surface of the photoconductive drum along the length of the photoconductive drum for removing residual toner from the outer surface of the photoconductive drum. The cleaner blade is mounted to an electrically conductive bracket and extends from the bracket toward the photoconductive drum. An electrical contact is exposed on the replaceable unit for mating with a corresponding electrical contact in the image forming device when the replaceable unit is installed in the image forming device to receive an electrical voltage from the corresponding electrical contact in the image forming device. The electrical contact of the replaceable unit is electrically connected to a first end portion of the shaft of the charge roll by way of a first electrical path and is electrically connected to a second end portion of the shaft of the charge roll by way of a second electrical path to transfer the electrical voltage to the charge roll for charging the outer surface of the photoconductive drum. The second end portion of the shaft of the charge roll is positioned opposite the first end portion of the shaft of the charge roll. The second electrical path includes the bracket.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
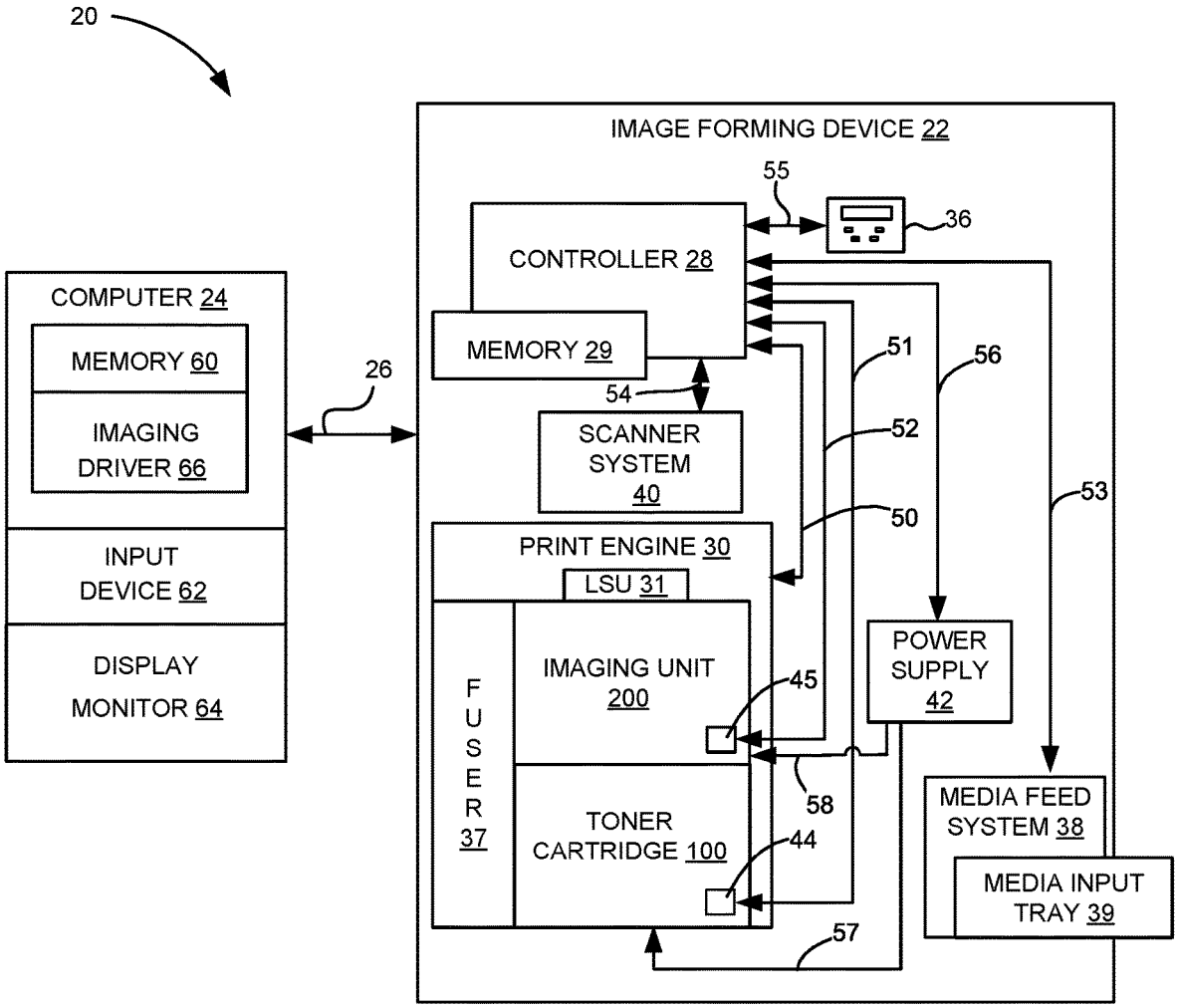
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AK)) device) that includes a controller 28, a print engine 30, a laser scan unit (LSU) 31, a toner cartridge 100, an imaging unit 200, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with power supply 42 via a communications link 56. Controller 28 processes print and scan data and operates print engine 30 during printing and scanner system 40 during scanning, Processing circuitry 44, 45 may provide authentication functions, safety and operational interlocks, operating parameters and usage information related to toner cartridge 100 and imaging unit 200, respectively, Each of processing circuitry 44, 45 includes a processor unit and associated electronic memory. As discussed above, the processor may include one or more integrated circuits in the form of a microprocessor or central processing unit and/or may include one or more Application-Specific integrated Circuits (ASICs). The memory may be any volatile and/or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a MID unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Toner cartridge 100 and imaging unit 200 are removably mounted in image forming device 22. Power supply 42 provides an electrical voltage to various components of toner cartridge 100 and imaging unit 200 via respective electrical paths 57 and 58. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelearic properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and one imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200. Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing; options such as a duplexer, a stapler or a hole-punch.

Figure 2:
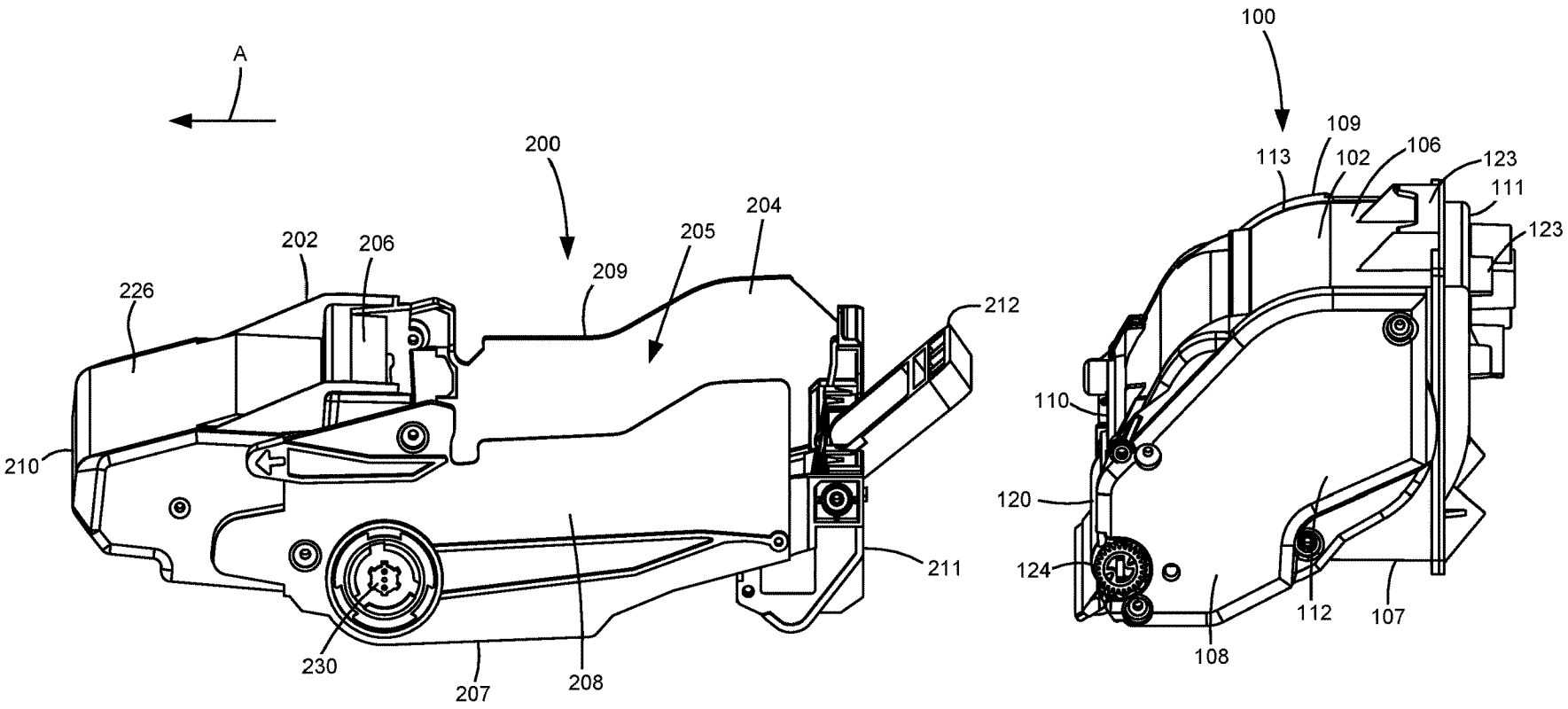
FIG. 2 is a perspective view of a toner cartridge and an imaging unit separated from each other according to one example embodiment.
Figure 3:
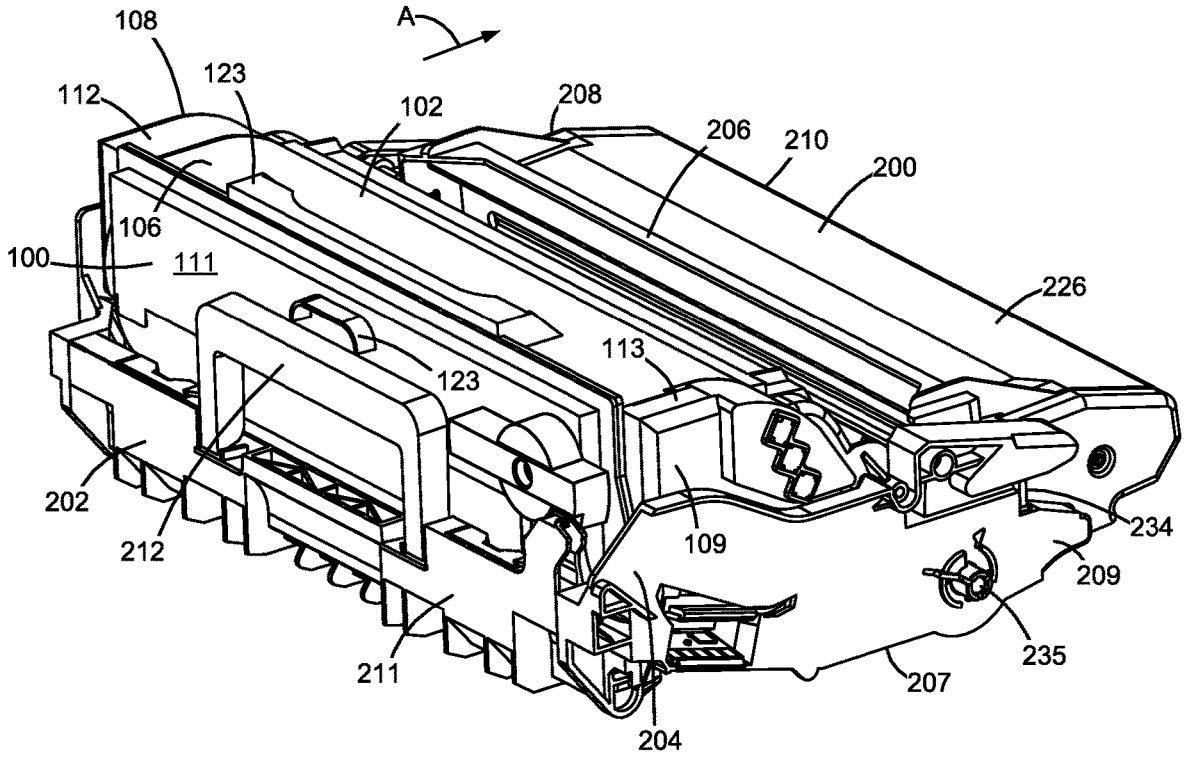
FIG. 3 is a perspective view of the toner cartridge and the imaging unit shown in FIG. 2 mated with each other according to one example embodiment.

Referring now to FIGS. 2 and 3, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200. Toner cartridge 100 and imaging unit 200 are then slidably inserted together into image forming device 22. FIG. 2 shows toner cartridge 100 and imaging unit 200 separated from each other, and FIG. 3 shows toner cartridge 100 installed on imaging unit 200. The arrow A shown in FIGS. 2 and 3 indicates the direction of insertion of toner cartridge 100 and imaging unit 200 into image forming device 22, This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

Figure 4:
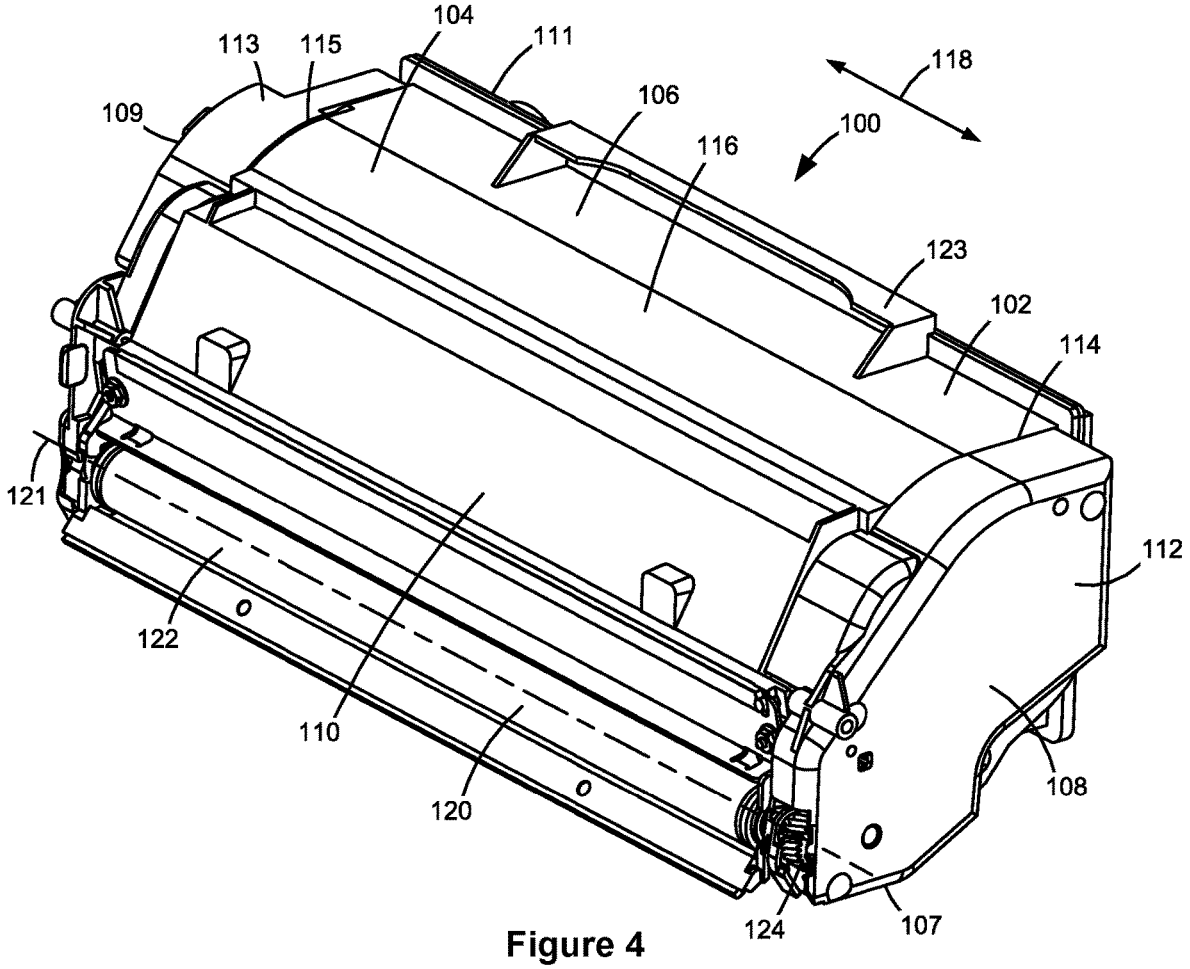
FIG. 4 is a perspective view of the toner cartridge shown in FIGS. 2 and 3.

With reference to FIGS. 2-4, toner cartridge 100 includes a housing 102 having an enclosed reservoir 104 for storing toner. Housing 102 includes a top 106, a bottom 107, first and second sides 108, 109, a front 110 and a rear 111. Front 110 of housing 102 leads during insertion of toner cartridge 100 into image forming device 22, and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109, A portion of an outer surface 122 of developer roll 120 is exposed from housing 102 along front 110 of housing 102, near bottom 107 of housing 102 for delivering toner from toner cartridge 100 to a corresponding photoconductive drum 220 (FIG. 5) of imaging unit 200. In this manner, developer roll 120 forms an outlet for exiting toner from toner cartridge 100.

A handle 123 may be provided on top 106 and/or rear 111 of housing 102 to assist with coupling and decoupling toner cartridge 100 to and from imaging unit 200 and with insertion and removal of toner cartridge 100 and imaging unit 200 into and out of image forming device 22. Toner cartridge 100 also includes an interface gear 124 positioned on side 108 of housing 102. In the embodiment illustrated, interface gear 124 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, interface gear 124 is mounted to a shaft of developer roll 120, coaxial with developer roll 120. In this embodiment, a front portion of interface gear 124 is exposed on the front 110 of housing 102, near bottom 107 of housing 102 and is unobstructed to mate with and receive rotational force from the corresponding drive gear on imaging unit 200. In the embodiment illustrated, interface gear 124 is rotatably connected to a drive train that is positioned between end cap 112 and side wall 114 of housing 102. The drive train aids in transferring rotational force from interface gear 124 to rotatable components of toner cartridge 100, including, for example, to a toner adder roll that provides toner from reservoir 104 to developer roll 120 and to one or more toner agitators that move toner in reservoir 104 toward the toner adder roll and that agitate and mix the toner in reservoir 104. In the example embodiment illustrated, interface gear 124 is formed as a helical gear, but other configurations may be used as desired.

With reference to FIGS. 2, 3, 5 and 6, imaging unit 200 includes a housing 202 including a top 206, a bottom 207, first and second sides 208, 209, a front 210 and a rear 211, Front 210 of housing 202 leads during insertion of imaging unit 200 into image forming device 22, and rear 211 trails. In the embodiment illustrated, frame 204 includes a toner cartridge receiving area 205 positioned at rear 211 of housing 202. A handle 212 is positioned on rear 211 of housing 202, e.g., on frame 204, to assist with insertion and removal of toner cartridge 100 and imaging unit 200 into and out of image forming device 22.

In the example embodiment illustrated, imaging unit 200 includes a rotatable photoconductive drum 220 having a rotational axis 221 that runs along a side-to-side dimension 218 of housing 202, from side 208 to side 209. A rear portion of photoconductive drum 220 is open to toner cartridge receiving area 205 of frame 204 for receiving toner from outer surface 122 of developer roll 120 of toner cartridge 100. A bottom portion of photoconductive drum 220 is exposed from housing 202 on bottom 207 of housing 202. Toner on an outer surface 222 of photoconductive drum 220 is transferred from the bottom portion of outer surface 222 of photoconductive drum 220 to a media sheet or intermediate transfer member during a print operation. Imaging unit 200 also includes a rotatable charge roll 224 in contact with outer surface 222 of photoconductive drum 220 along a length of photoconductive drum 220 that charges outer surface 222 of photoconductive drum 220 to a predetermined voltage. Imaging unit 200 also includes a waste toner removal system that may include a cleaner blade or roll that removes residual toner from outer surface 222 of photoconductive drum 220. In the example embodiment illustrated, imaging unit 200 includes a waste toner reservoir 226 positioned at the front 210 of housing 202. Waste toner reservoir 226 stores toner removed from photoconductive drum 220 by the cleaner blade or roll.

Imaging unit 200 also includes a drive coupler 230 positioned on side 208 of housing 202. Drive coupler 230 mates with and receives rotational force from a corresponding drive coupler in image forming device 22 in order to provide rotational force to photoconductive drum 220 when imaging unit 200 is installed in image forming device 22. In the embodiment illustrated, drive coupler 230 is positioned at an axial end of photoconductive drum 220, coaxial with photoconductive drum 220. In this embodiment, an outer axial end of drive coupler 230 is exposed on side 208 of housing 202 and is unobstructed to mate with and receive rotational force from the corresponding drive coupler in image forming device 22. In the example embodiment illustrated, drive coupler 230 is configured to receive rotational force at the outer axial end of drive coupler 230, but other configurations may be used as desired. In some embodiments, charge roll 224 is driven by friction contact between the surfaces of charge roll 224 and photoconductive drum 220. In other embodiments, charge roll 224 is connected to drive coupler 230 by one or more gears.

In the embodiment illustrated, imaging unit 200 also includes a drive gear 232 attached to photoconductive drum 220, axially inboard of drive coupler 230. A portion of drive gear 232 is exposed to toner cartridge receiving area 205 of frame 204 permitting interface gear 124 of toner cartridge 100 to mate with drive gear 232 of imaging unit 200 when toner cartridge 100 is installed on frame 204 of imaging unit 200 to permit the transfer of rotational force received by drive coupler 230 of imaging unit 200 to interface gear 124 of toner cartridge 100 by way of drive gear 232 of imaging unit 200.

Imaging unit 200 also includes one or more electrical contacts 234, 235 that mate with corresponding electrical contacts in image forming device 22 when imaging unit 200 is installed in image forming device 22 in order to facilitate electrical path 58 between power supply 42 of image forming device 22 and one or more imaging components of imaging unit 200. For example, in the embodiment illustrated, electrical contact 234 provides an electrical connection to charge roll 224, and electrical contact 235 provides an electrical connection to photoconductive drum 220.

Figure 5:
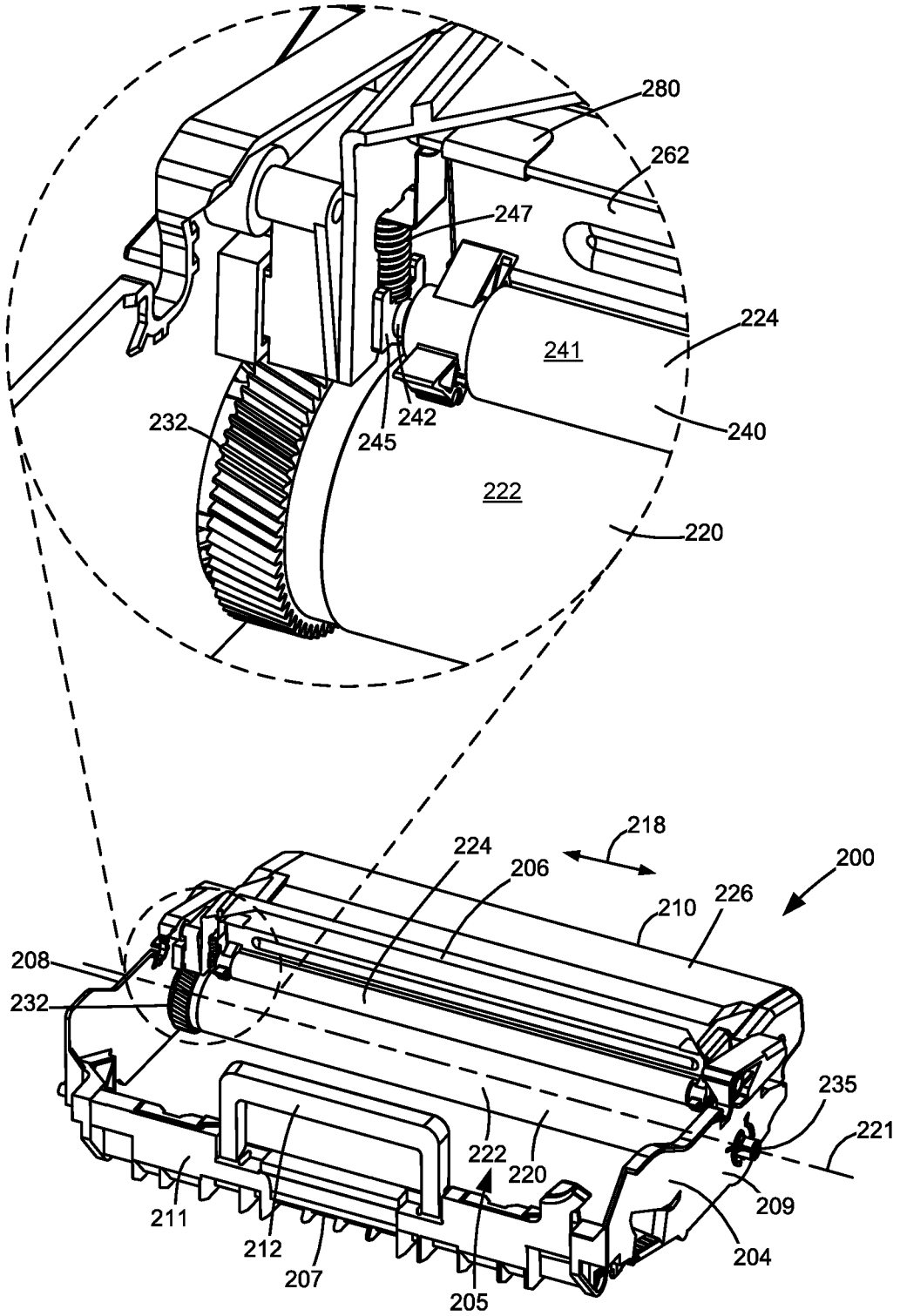
FIG. 5 is a first perspective view of the imaging unit shown in FIGS. 2 and 3.
Figure 6:
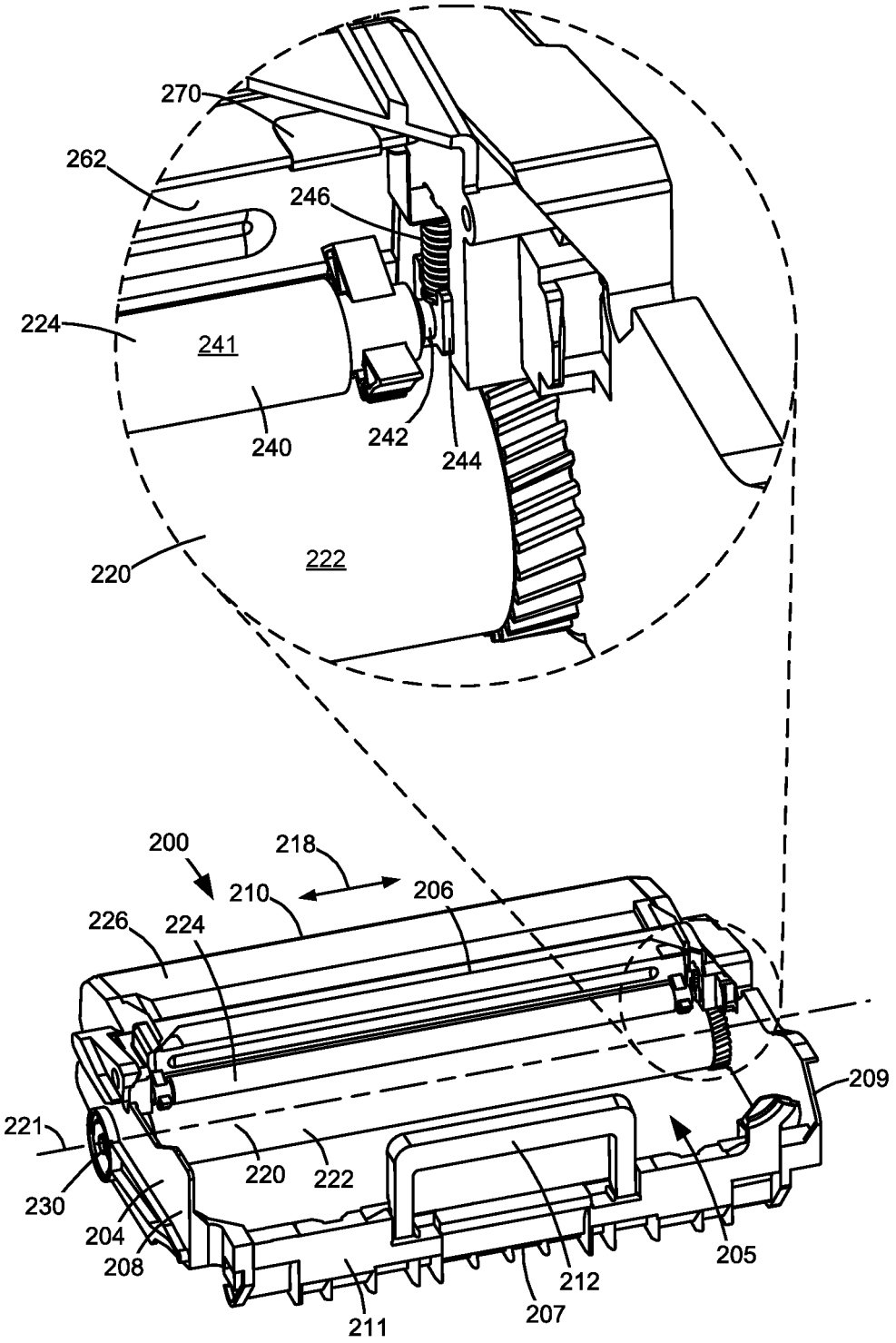
FIG. 6 is a second perspective view of the imaging unit shown in FIGS. 2 and 3.
Figure 7:
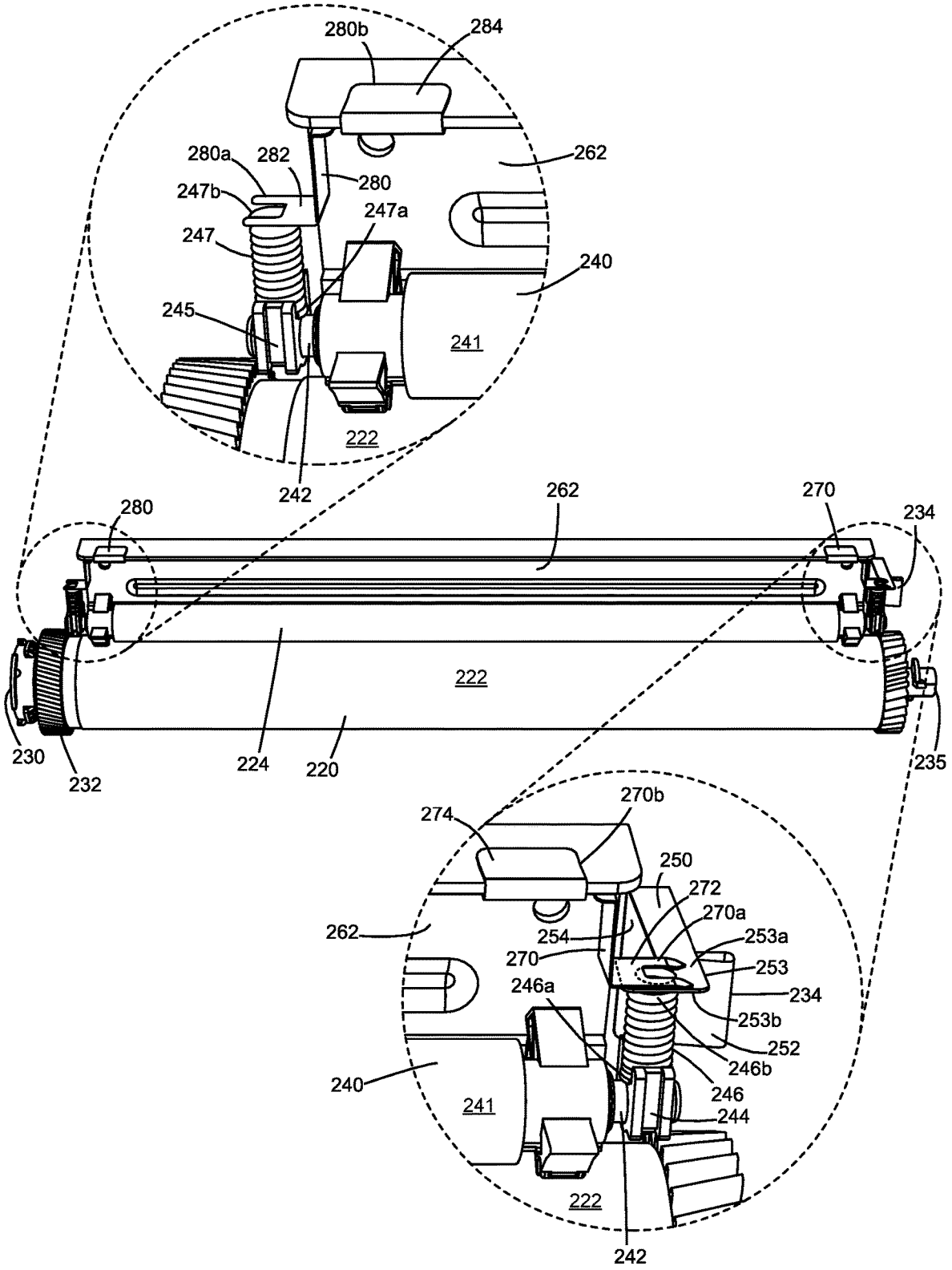
FIG. 7 is a perspective view of a charge roll electrical path of the imaging unit according to one example embodiment.

With reference to FIGS. 5-7, an electrical path from electrical contact 234 of imaging unit 200 to charge roll 224 is shown according to one example embodiment for providing an electrical voltage from power supply 42 to charge roll 224 when imaging unit 200 is installed in image forming device 22 for charging outer surface 222 of photoconductive drum 220. FIGS. 5 and 6 include perspective views of imaging unit 200, and FIG. 7 shows a subassembly of imaging unit 200 that includes the electrical path from electrical contact 234 of imaging unit 200 to charge roll 224. Charge roll 224 includes a roll body 240 cylindrically disposed around a rotatable shaft 242. In the embodiment illustrated, roll body 240 is composed of an electrically conductive foam material (e.g., a polyurethane coated roll with a nitrile rubber (NBR) or epichlorohydrin rubber (ECO) core). Shaft 242 is composed of an electrically conductive material, such as a metal (e.g., stainless steel, nickel-plated steel, or steel with another electrically conductive plating/coating). End portions of shaft 242 are rotatably supported by bushings 244, 245, Bushings 244, 245 position charge roll 224 relative to photoconductive drum 220 and support the rotation of charge roll 224. In the embodiment illustrated, bushings 244, 245 are each composed of an electrically conductive material, such as an electrically conductive plastic (e.g., conductive acetal plastic) or a metal (e.g., sintered bronze).

Each bushing 244, 245 is physically biased by a corresponding bias spring 246, 247. The bias force applied to bushings 244, 245 by springs 246, 247 biases charge roll 224 against photoconductive drum 220. Specifically, the bias force applied to bushings 244, 245 by springs 246, 247 presses an outer surface 241 of roll body 240 of charge roll 224 against outer surface 222 of photoconductive drum 220. In the embodiment illustrated, springs 246, 247 are compression springs; however, any suitable spring may be used as desired, including, for example, extension springs, leaf springs, etc. In the embodiment illustrated, springs 246, 247 are each composed of an electrically conductive material, such as a metal (e.g., tempered steel or tempered stainless steel). In the embodiment illustrated, a first end 246*a*, 247*a* of each spring 246, 247 contacts the corresponding bushing 244, 245.

Figure 8:
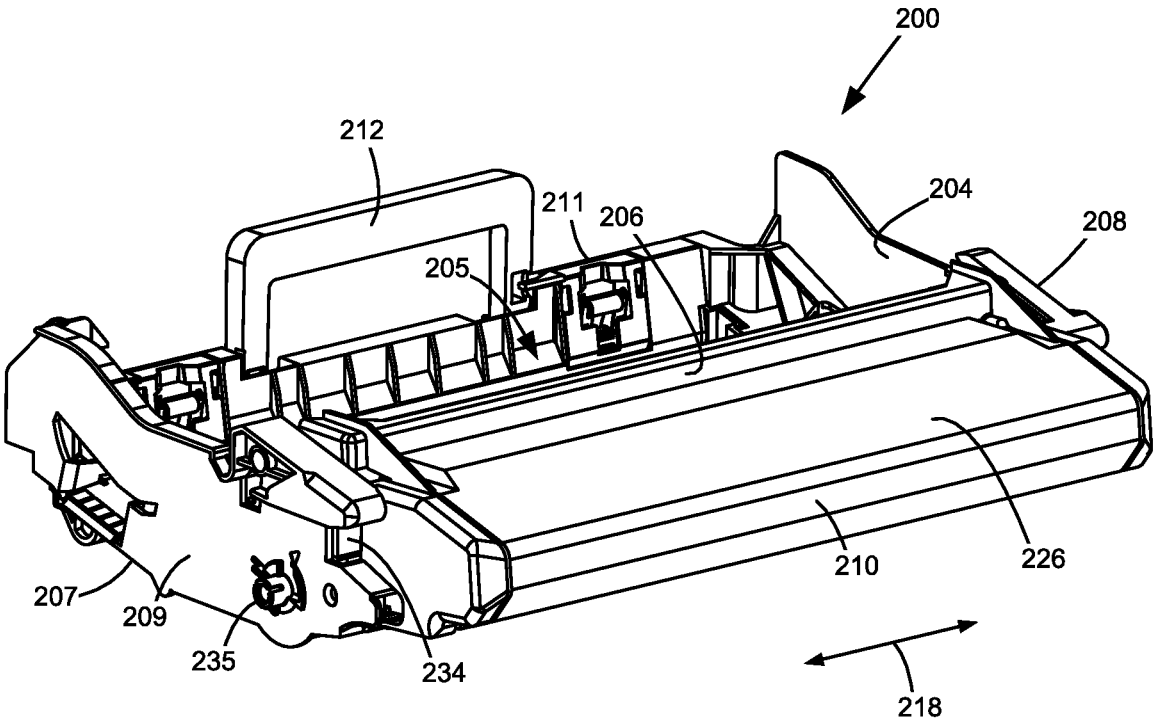
FIG. 8 is a third perspective view of the imaging unit shown in FIGS. 2 and 3.

With reference to FIGS. 7 and 8, electrical contact 234 is shown exposed on an exterior portion of imaging unit 200, such as on side 209 facing toward front 210, permitting electrical contact 234 to contact a corresponding electrical contact in image forming device 22 when imaging unit 200 is installed in image forming device 22. In the embodiment illustrated, electrical contact 234 is formed by a multi-segmented metal plate 250. A first segment 252 of plate 250 is exposed on the exterior of imaging unit 200 and forms electrical contact 234. A second segment 253 of plate 250 contacts a second end 246*b* of spring 246. Plate 250 may include one or more connecting segments 254 linking first segment 252 to second segment 253. Plate 250 provides an electrical path from electrical contact 234 to spring 246. Spring 246 is, in turn, electrically connected to roll body 240 of charge roll 224 by way of bushing 244 and shaft 242. Accordingly, voltage received by electrical contact 234 when imaging unit 200 is installed in image forming device 22 travels from plate 250 to spring 246, from spring 246 to bushing 244, from bushing 244 to shaft 242, and from shaft 242 to roll body 240 allowing roll body 240 of charge roll 224 to charge the outer surface 222 of photoconductive drum 220, In the embodiment illustrated, a single, unitary plate 250 transfers electrical voltage from electrical contact 234 to spring 246; however, the electrical path from electrical contact 234 to spring 246 may include multiple electrically conductive elements as desired.

Figure 9:
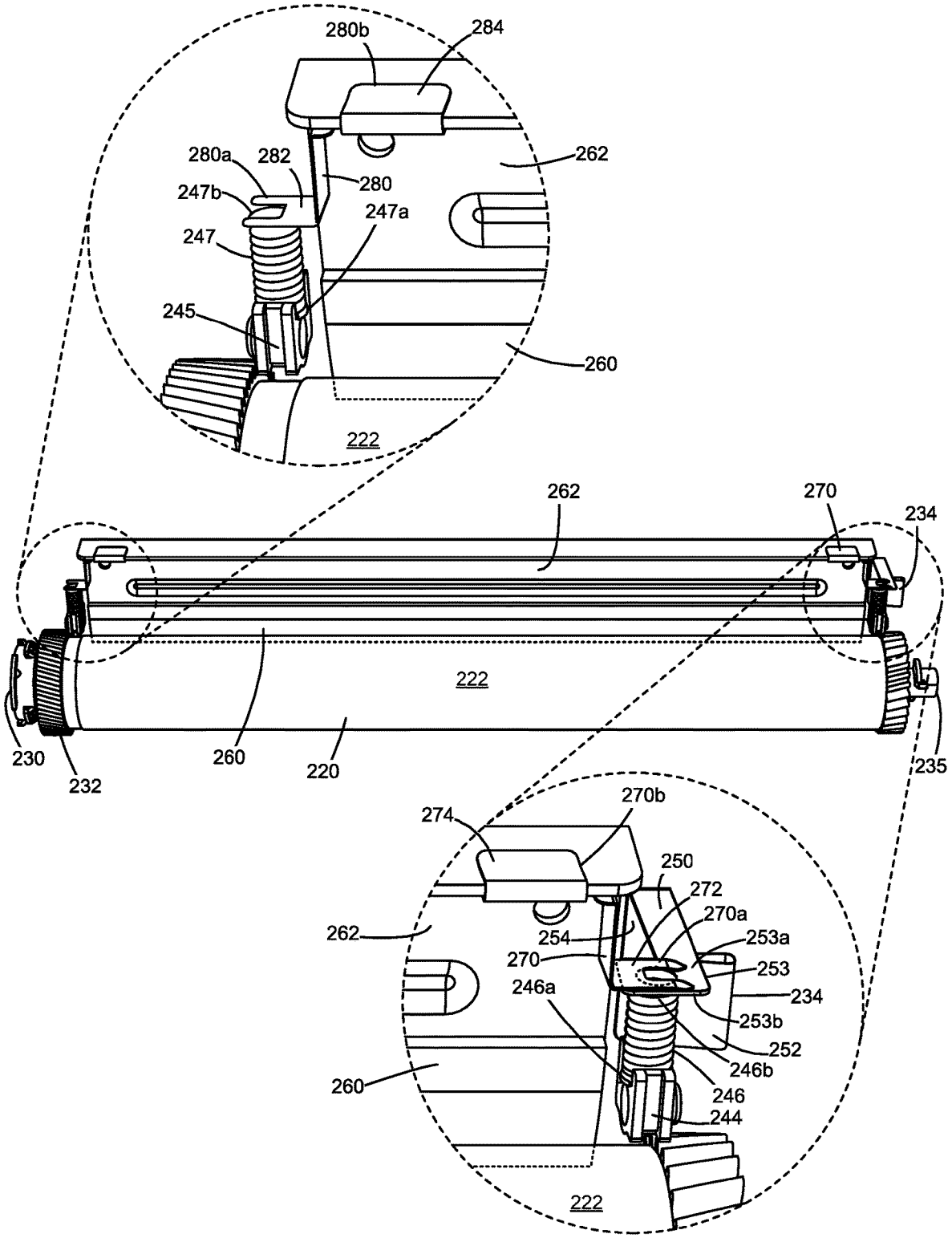
FIG. 9 is a perspective view of the electrical path shown in FIG. 7 with a charge roll omitted to show a cleaner blade according to one example embodiment.

FIG. 9 shows the subassembly of FIG. 7 with charge roll 224 omitted. As shown in FIG. 9, a cleaner blade 260 contacts outer surface 222 of photoconductive drum 220 along the length of photoconductive drum 220. FIG. 9 shows portions of cleaner blade 260 that are obscured by photoconductive drum 220 in dashed line. Cleaner blade 260 is positioned to remove residual toner from outer surface 222 of photoconductive drum 220 prior to charging by charge roll 224. Cleaner blade 260 is attached to and extends in a cantilevered manner from a bracket 262 that is mounted to housing 202 of imaging unit 200, Bracket 262 mounts cleaner blade 260 to housing 202 of imaging unit 200 and positions cleaner blade 260 relative to photoconductive drum 220. In the embodiment illustrated, bracket 262 is composed of an electrically conductive material, such as a metal (e.g., pre-plated steel, stainless steel, or steel with an electrically conductive plating/coating). In this embodiment, bracket 262 is in a spaced relationship from charge roll 224 such that bracket 262 does not contact roll body 240 or shaft 242.

With reference to FIGS. 7 and 9, electrical contact 234 is electrically connected to bracket 262, and bracket 262 is electrically connected to spring 247 providing an additional electrical connection from electrical contact 234 to charge roll 224 in order ensure that a continuous electrical connection is maintained between electrical contact 234 and charge roll 224. Maintaining a continuous electrical connection between electrical contact 234 and charge roll 224 helps reduce the occurrence of print defects that may occur if outer surface 222 of photoconductive drum 220 is not adequately charged by charge roll 224. The electrical connection between electrical contact 234 and bracket 262 also allows an electrical voltage to be applied to cleaner blade 260 as desired by constructing cleaner blade 260 from an electrically non-insulative material (e.g., an electrically semi-resistive or semi-conductive material such as conductive polyurethane).

In the embodiment illustrated, a first electrically conductive (e.g., metal) tab 270 electrically connects electrical contact 234 to bracket 262, and a second electrically conductive (e.g., metal) tab 280 electrically connects bracket 262 to spring 247. In this embodiment, each tab 270, 280 includes a contact pad 272, 282 positioned at a first end 270*a*, 280*a* of the tab 270, 280. In the embodiment illustrated, contact pad 272 of tab 270 contacts a first side 253*a* of second segment 253 of plate 250 forming electrical contact 234, and spring 246 contacts a second side 253*b* of second segment 253 of plate 250. However, in other embodiments, contact pad 272 of tab 270 may directly contact spring 246. For example, contact pad 272 of tab 270 may be sandwiched between and in direct contact with second side 253*b* of second segment 253 of plate 250 and with second end 246*b* of spring 246 such that electrical voltage passing from electrical contact 234 to spring 246 passes through tab 270. FIGS. 7 and 9 show the portions of second segment 253 of plate 250 that are obscured by contact pad 272 of tab 270 in dashed line. In the embodiment illustrated, contact pad 282 of tab 280 directly contacts a second end 247*b* of spring 247. However, in other embodiments, contact pad 282 of tab 280 may be indirectly connected to spring 246.

In the embodiment illustrated, each tab 270, 280 includes a clip 274, 284 positioned at a second end 270*b*, 280*b* of the tab 270, 280. Clips 274, 284 are configured to attach to bracket 262 by way of a friction-fit engagement allowing clips 274, 284 to manually attach to bracket 262 during assembly of imaging unit 200. However, tabs 270, 280 may attach to bracket 262 by other means, e.g., by one or more fasteners.

By electrically connecting electrical contact 234 to bracket 262 and bracket 262 to spring 247, tabs 270, 280 provide a second electrical path from electrical contact 234 to charge roll 224, In the embodiment illustrated, tabs 270, 280 allow voltage received by electrical contact 234 when imaging unit 200 is installed in image forming device 22 to travel from plate 250 to tab 270, from tab 270 to bracket 262, from bracket 262 to tab 280, from tab 280 to spring 247, from spring 247 to bushing 245, from bushing 245 to shaft 242, and from shaft 242 to roll body 240 in order to ensure that roll body 240 of charge roll 224 is able to charge the outer surface 222 of photoconductive drum 220, Providing an electrical connection from electrical contact 234 to each end of shaft 242 of charge roll 224 helps ensure that a continuous electrical connection is maintained between electrical contact 234 and charge roll 224 so that outer surface 222 of photoconductive drum 220 remains adequately charged in order to prevent print defects.

As mentioned above, the electrical connection between electrical contact 234 and bracket 262 also allows an electrical voltage to be applied to cleaner blade 260 as desired. It may be desired to apply an electrical voltage to cleaner blade 260 in order to help facilitate the removal of residual toner from outer surface 222 of photoconductive drum 220 by cleaner blade 260. The electrical bias on cleaner blade 260 may be specifically tailored by constructing cleaner blade 260 from a material having a known electrical resistivity. If, on the other hand, no electrical bias on cleaner blade 260 is desired, cleaner blade 260 may be constructed from an electrically insulative material.

Figure 10:
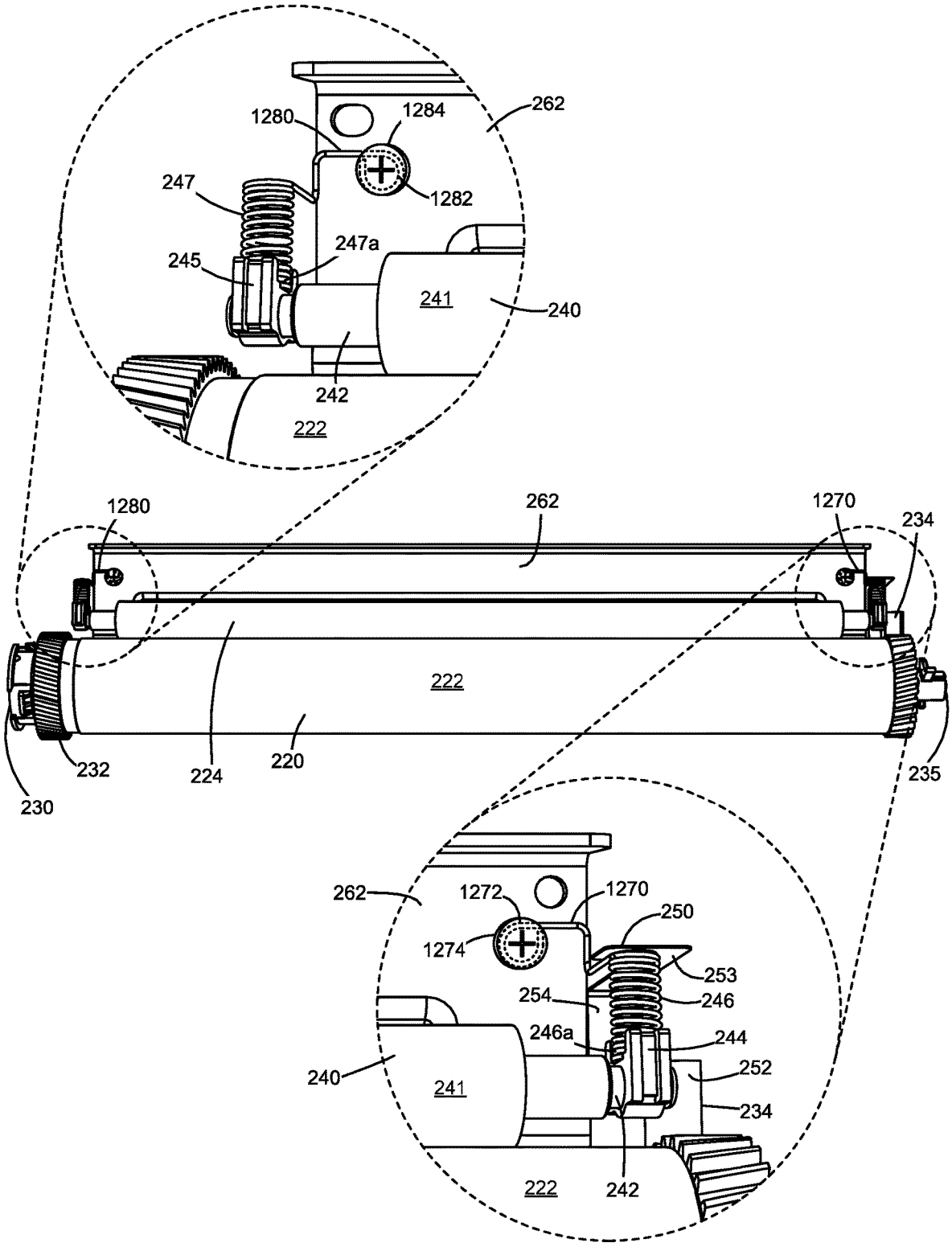
FIG. 10 is a perspective view of a charge roll electrical path of the imaging unit according to another example embodiment.

With reference to FIG. 10, an electrical path from electrical contact 234 of imaging unit 200 to charge roll 224 is shown according to another example embodiment when imaging unit 200 is installed in image forming device 22. In the example embodiment illustrated in FIG. 10, tabs 270, 280 are replaced by spring extensions 1270, 1280. In this embodiment, a first spring extension 1270 from spring 246 electrically connects electrical contact 234 to bracket 262, and a second spring extension 1280 from spring 247 electrically connects bracket 262 to spring 247. In the embodiment illustrated, spring extensions 1270, 1280 are formed integrally with springs 246, 247; however, in other embodiments, spring extensions 1270, 1280 may be formed by a separate electrically conductive element that electrically connects springs 246, 247 to bracket 262. In the embodiment illustrated, end portions 1272, 1282 of spring extensions 1270, 1280 are attached to or held against bracket 262 by fasteners 1274, 1284 in order to ensure that contact is maintained between spring extensions 1270, 1280 and bracket 262. FIG. 10 shows the portions of end portions 1272, 1282 of spring extensions 1270, 1280 that are obscured by fasteners 1274, 1284 in dashed line. In some embodiments, fasteners 1274, 1284 are electrically conductive such that fasteners 1274, 1284 also provide an electrical connection between spring extensions 1270, 1280 and bracket 262 if physical contact is lost between bracket 2172 and either spring extension 1270, 1280. In other embodiments, fasteners 1274, 1284 are not sufficiently electrically conductive to provide an electrical connection, but fasteners 1274, 1284 are positioned to ensure that sufficient mechanical and electrical contact is maintained between spring extensions 1270, 1280 and bracket 262.

In the embodiment shown in FIG. 10, an electrical connection is provided from electrical contact 234 to each end of shaft 242 of charge roll 224 in order to help ensure that a continuous electrical connection is maintained between electrical contact 234 and charge roll 224. In this embodiment, the electrical path from electrical contact 234 to the end of shaft 242 supported by bushing 244 remains the same as the embodiment discussed above with respect to FIGS. 7 and 9, i.e., voltage received by electrical contact 234 travels from plate 250 to spring 246, from spring 246 to bushing 244, from bushing 244 to shaft 242, and from shaft 242 to roll body 240. In the embodiment shown in FIG. 10, the electrical path from electrical contact 234 to the end of shaft 242 supported by bushing 245 includes spring extensions 1270, 1280 instead of tabs 270, 280 shown in FIGS. 7 and 9, i.e., voltage received by electrical contact 234 travels from plate 250 to spring extension 1270, from spring extension 1270 to bracket 262, from bracket 262 to spring extension 1280, from spring extension 1280 to spring 247, from spring 247 to bushing 245, from bushing 245 to shaft 242, and from shaft 242 to roll body 240.

While the example embodiments illustrated include a redundant electrical path for providing an electrical voltage to a charge roll that utilizes a bracket supporting a cleaner blade, it will be appreciated that the teachings of the present disclosure may be applied to provide a continuous electrical path to other imaging components. For example, a redundant electrical path may provide an electrical voltage to a developer roll and may utilize a bracket supporting a doctor blade in a similar manner to the embodiments illustrated.

Although the example embodiment discussed above includes a pair of replaceable units in the form of a toner cartridge 100 that includes the main toner supply for the image forming device and the developer unit and an imaging unit 200 that includes the photoconductor unit for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device, the developer unit and the photoconductor unit are provided in a single replaceable unit. Other configurations may be used as desired.

Further, it will be appreciated that the architecture and shape of toner cartridge 100 and imaging unit 200 illustrated is merely intended to serve as an example. Those skilled in the art understand that toner cartridges, imaging units, and other toner containers, may take many, different shapes and configurations. Those skilled in the art will also appreciate that positional relationships described herein (e.g., above, below, top, bottom, etc.) refer to operative positions of the image forming device and its components.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for an electrophotographic image forming device, comprising:

a rotatable roll having an electrically conductive shaft;

an electrically conductive bracket positioned adjacent to the roll and in a spaced relationship from the roll along a length of the roll; and an electrical contact positioned to receive an electrical voltage from a power supply of the image forming device, the electrical contact is electrically connected to a first end portion of the shaft of the roll by way of a first electrical path and electrically connected to a second end portion of the shaft of the roll by way of a second electrical path to transfer the electrical voltage to the roll, the second end portion of the shaft of the roll is positioned opposite the first end portion of the shaft of the roll, the bracket forms a portion of the second electrical path such that the electrical voltage transferring from the electrical contact to the second end portion of the shaft of the roll passes through the bracket.

2. The assembly of claim 1, wherein the rotatable roll includes a rotatable charge roll having an outer surface that contacts an outer surface of a photoconductive drum along a length of the photoconductive drum.

3. The assembly of claim 2, further comprising a cleaner blade mounted to the electrically conductive bracket, the cleaner blade is in contact with the outer surface of the photoconductive drum along the length of the photoconductive drum for removing residual toner from the outer surface of the photoconductive drum.

4. The assembly of claim 1, further comprising a first electrically conductive spring and a second electrically conductive spring, the first spring biases the first end portion of the shaft of the roll, the second spring biases the second end portion of the shaft of the roll, the first spring forms a portion of the first electrical path such that the electrical voltage transferring from the electrical contact to the first end portion of the shaft of the roll passes through the first spring, the second spring is electrically connected to the bracket and forms a portion of the second electrical path such that the electrical voltage transferring from the electrical contact to the second end portion of the shaft of the roll passes through the bracket and the second spring.

5. An assembly for an electrophotographic image forming device, comprising:

a rotatable photoconductive drum;

a rotatable charge roll having an electrically conductive shaft, an outer surface of the charge roll contacts an outer surface of the photoconductive drum along a length of the photoconductive drum;

a cleaner blade in contact with the outer surface of the photoconductive drum along the length of the photoconductive drum for removing residual toner from the outer surface of the photoconductive drum;

an electrically conductive bracket, the cleaner blade is mounted to the bracket and extends from the bracket toward the photoconductive drum; and an electrical contact positioned to receive an electrical voltage from a power supply of the image forming device, the electrical contact is electrically connected to a first end portion of the shaft of the charge roll by way of a first electrical path and electrically connected to a second end portion of the shaft of the charge roll by way of a second electrical path to transfer the electrical voltage to the charge roll for charging the outer surface of the photoconductive drum, the second end portion of the shaft of the charge roll is positioned opposite the first end portion of the shaft of the charge roll, the bracket forms a portion of the second electrical path such that the electrical voltage transferring from the electrical contact to the second end portion of the shaft of the charge roll passes through the bracket.

6. The assembly of claim 5, further comprising a first electrically conductive spring and a second electrically conductive spring, the first spring biases the first end portion of the shaft of the charge roll toward the photoconductive drum, the second spring biases the second end portion of the shaft of the charge roll toward the photoconductive drum, the first spring forms a portion of the first electrical path such that the electrical voltage transferring from the electrical contact to the first end portion of the shaft of the charge roll passes through the first spring, the second spring is electrically connected to the bracket and forms a portion of the second electrical path such that the electrical voltage transferring from the electrical contact to the second end portion of the shaft of the charge roll passes through the bracket and the second spring.

7. The assembly of claim 6, further comprising a first electrically conductive tab and a second electrically conductive tab, each of the first and second tabs is attached to the bracket by way of a friction-fit engagement with the bracket, the first tab electrically connects the electrical contact to the bracket and the second tab electrically connects the bracket to the second spring such that the electrical voltage traveling along the second electrical path travels from the first tab to the bracket and from the bracket to the second tab.

8. The assembly of claim 6, further comprising a first electrically conductive tab and a second electrically conductive tab, each of the first and second tabs is attached to the bracket by way of a fastener-free engagement with the bracket, the first tab electrically connects the electrical contact to the bracket and the second tab electrically connects the bracket to the second spring such that the electrical voltage traveling along the second electrical path travels from the first tab to the bracket and from the bracket to the second tab.

9. The assembly of claim 6, further comprising a first electrically conductive spring extension from the first spring and a second electrically conductive spring extension from the second spring, each of the first and second spring extensions is attached to the bracket by a respective fastener, the first spring extension electrically connects the electrical contact to the bracket and the second spring extension electrically connects the bracket to the second spring such that the electrical voltage traveling along the second electrical path travels from the first spring extension to the bracket and from the bracket to the second spring extension.

10. The assembly of claim 5, further comprising a first electrically conductive spring and a second electrically conductive spring, the first spring biases the first end portion of the shaft of the charge roll toward the photoconductive drum, the second spring biases the second end portion of the shaft of the charge roll toward the photoconductive drum, the first spring is electrically connected to the bracket proximate to the first end portion of the shaft of the charge roll, and the second spring is electrically connected to the bracket proximate to the second end portion of the shaft of the charge roll.

11. The assembly of claim 5, wherein the cleaner blade is composed of an electrically non-insulative material such that the electrical contact is electrically connected to the cleaner blade by way of the second electrical path.

12. A replaceable unit for use in an electrophotographic image forming device, comprising:

a rotatable photoconductive drum;

a rotatable charge roll having an electrically conductive shaft, an outer surface of the charge roll contacts an outer surface of the photoconductive drum along a length of the photoconductive drum;

a cleaner blade in contact with the outer surface of the photoconductive drum along the length of the photoconductive drum for removing residual toner from the outer surface of the photoconductive drum;

an electrically conductive bracket, the cleaner blade is mounted to the bracket and extends from the bracket toward the photoconductive drum; and an electrical contact exposed on the replaceable unit for mating with a corresponding electrical contact in the image forming device when the replaceable unit is installed in the image forming device to receive an electrical voltage from the corresponding electrical contact in the image forming device, the electrical contact of the replaceable unit is electrically connected to a first end portion of the shaft of the charge roll by way of a first electrical path and electrically connected to a second end portion of the shaft of the charge roll by way of a second electrical path to transfer the electrical voltage to the charge roll for charging the outer surface of the photoconductive drum, the second end portion of the shaft of the charge roll is positioned opposite the first end portion of the shaft of the charge roll, the second electrical path includes the bracket.

13. The replaceable unit of claim 12, further comprising a first electrically conductive spring and a second electrically conductive spring, the first spring biases the first end portion of the shaft of the charge roll toward the photoconductive drum, the second spring biases the second end portion of the shaft of the charge roll toward the photoconductive drum, the first spring forms a portion of the first electrical path such that the electrical voltage transferring from the electrical contact of the replaceable unit to the first end portion of the shaft of the charge roll passes through the first spring, the second spring is electrically connected to the bracket and forms a portion of the second electrical path such that the electrical voltage transferring from the electrical contact of the replaceable unit to the second end portion of the shaft of the charge roll passes through the bracket and the second spring.

14. The replaceable unit of claim 13, further comprising a first electrically conductive tab and a second electrically conductive tab, each of the first and second tabs is attached to the bracket by way of a friction-fit engagement with the bracket, the first tab electrically connects the electrical contact of the replaceable unit to the bracket and the second tab electrically connects the bracket to the second spring such that the electrical voltage traveling along the second electrical path travels from the first tab to the bracket and from the bracket to the second tab.

15. The replaceable unit of claim 13, further comprising a first electrically conductive tab and a second electrically conductive tab, each of the first and second tabs is attached to the bracket by way of a fastener-free engagement with the bracket, the first tab electrically connects the electrical contact of the replaceable unit to the bracket and the second tab electrically connects the bracket to the second spring such that the electrical voltage traveling along the second electrical path travels from the first tab to the bracket and from the bracket to the second tab.

16. The replaceable unit of claim 13, further comprising a first electrically conductive spring extension from the first spring and a second electrically conductive spring extension from the second spring, each of the first and second spring extensions is attached to the bracket by a respective fastener, the first spring extension electrically connects the electrical contact of the replaceable unit to the bracket and the second spring extension electrically connects the bracket to the second spring such that the electrical voltage traveling along the second electrical path travels from the first spring extension to the bracket and from the bracket to the second spring extension.

17. The replaceable unit of claim 12, further comprising a first electrically conductive spring and a second electrically conductive spring, the first spring biases the first end portion of the shaft of the charge roll toward the photoconductive drum, the second spring biases the second end portion of the shaft of the charge roll toward the photoconductive drum, the first spring is electrically connected to the bracket proximate to the first end portion of the shaft of the charge roll, and the second spring is electrically connected to the bracket proximate to the second end portion of the shaft of the charge roll.

18. The replaceable unit of claim 12, wherein the cleaner blade is composed of an electrically non-insulative material such that the electrical contact of the replaceable unit is electrically connected to the cleaner blade by way of the second electrical path.

* * * * *